United States Patent [19]

Tanel

[11] Patent Number: 4,723,365

[45] Date of Patent: Feb. 9, 1988

[54] SOLE FOR PIVOTING SOCCER SHOE AND THE LIKE

[75] Inventor: Michael L. Tanel, Milwaukee, Wis.

[73] Assignee: Tanel Corporation, Milwaukee, Wis.

[21] Appl. No.: 4,549

[22] Filed: Jan. 16, 1987

Related U.S. Application Data

[63] Continuation-in-part of Ser. No. 800,740, Nov. 22, 1985, and a continuation-in-part of Ser. No. 854,409, Apr. 21, 1986, Pat. No. 4,669,204, which is a continuation-in-part of Ser. No. 800,740, Nov. 22, 1985, Pat. No. 4,660,304, which is a continuation-in-part of Ser. No. 565,746, Dec. 27, 1983, Pat. No. 4,577,422.

[51] Int. Cl.[4] ..... A43B 5/02; A43B 5/00; A43C 15/16

[52] U.S. Cl. ..... 36/126; 36/128; 36/59 C; 36/67 R

[58] Field of Search ..... 36/126, 128, 134, 127, 36/129, 59 R, 59 C, 32 R, 67 R, 67 A

[56] References Cited

U.S. PATENT DOCUMENTS

| | | | |
|---|---|---|---|
| D. 171,130 | 12/1953 | Gruner | D2/320 |
| 825,869 | 7/1906 | Sandeman | 36/132 |
| 844,057 | 2/1907 | Tillinghast | 36/132 |
| 1,552,022 | 9/1925 | Willson | 36/59 C |
| 2,677,905 | 5/1954 | Dye | 36/134 |
| 2,678,507 | 5/1954 | Dye | 36/134 |
| 3,466,763 | 9/1969 | Levin | 36/134 |
| 4,266,349 | 5/1981 | Schmohl | 36/32 R |
| 4,347,674 | 9/1982 | George | 36/126 |
| 4,577,422 | 3/1986 | Tanel | 36/126 |

*Primary Examiner*—Steven N. Meyers

*Attorney, Agent, or Firm*—Jansson, Peter N.

[57] ABSTRACT

An improved sole for soccer shoes of the type having an annular cleat providing improved pivotability and excellent traction. The annular cleat extends along a substantially circular path which has medial and lateral opposed main side portions, the inside main side portion being spaced from the inside sole edge by a distance substantially greater than the lateral main side portion is from the sole outside edge. Preferred embodiments have opposed breaks along the opposed main side portions.

11 Claims, 11 Drawing Figures

SOLE FOR PIVOTING SOCCER SHOE AND THE LIKE

RELATED APPLICATIONS

This is a continuation-in-part of my copending patent application Ser. No. 800,740, filed Nov. 22, 1985, entitled IMPROVED PIVOTING ATHLETIC SHOE, and of my copending patent application Ser. No. 854,409, filed Apr. 21, 1986. entitled IMPROVED PIVOTING ATHLETIC SHOE. Patent application Ser. No. 854,409, now U.S. Pat. No. 4,669,204, is a continuation-in-part of patent application Ser. No. 800,740, now U.S. Pat. No. 4,660,304, which in turn is a continuation-in-part of my patent application Ser. No. 565,746, filed Dec. 27, 1983, entitled ATHLETIC SHOE WITH IMPROVED PIVOT CLEATING, now U.S. Pat. No. 4,577,422.

FIELD OF THE INVENTION

This invention is related generally to athletic shoes of the type having cleats and, more specifically, to athletic shoes and shoe soles for soccer and the like with cleating facilitating pivoting movements.

BACKGROUND OF THE INVENTION

Most athletic shoes used for field sports, such as soccer, football, baseball, softball and lacrosse, have a number of either tapered or blade-like cleats for the purpose of increasing traction. Cleats dig into the turf to prevent slipping during starting, stopping, and cutting maneuvers.

Such cleats, however, in addition to providing desirable traction for starting, stopping and cutting, typically provide very undesirable resistance to pivoting. This can be a disadvantage in two ways.

When pivoting is inhibited, the maneuverability of the athlete is limited. His performance is less than it could be. Enhancing the ability of a player to pivot can greatly increase his effectiveness on the field.

In addition to inhibiting certain pivoting actions which athletes attempt or would like to attempt, many cleats of the prior art tend to resist turning movements which can relieve stresses within the leg when unwanted torque or force is applied to the athlete, particularly to the athlete's leg. If a twisting moment is forcibly applied to a leg at a time when the cleats are firmly planted into the turf and release from the turf is not possible, injuries can result, particularly common knee injuries.

Some athletic shoes have cleats intended to accommodate pivoting movements. One approach has used fixed annular cleats. The performance of such shoes can vary greatly, depending on various factors. However, the annular-cleated athletic shoes of the aforementioned United States patents provide greatly improved pivotability and excellent traction, and reduce the chance of athletic injuries.

The improvement in pivotability made possible with shoes in accordance with the principles of such patents is dramatic, and such shoes give the athletes wearing them a natural feeling of freedom together with a good feeling of traction for stopping, starting and cutting.

The invention described and claimed herein relates generally to athletic shoes having substantially continuous annular cleats. The substantially continuous annular cleats of this invention, however, are particularly useful for soccer and the like, providing advantages especially useful in that sport.

The advantages of the aforementioned annular cleating for soccer is quickly appreciated. However, certain common kicking actions using the medial edge of the forefoot can be impeded to a slight extent by the annular ring. In particular, such kicking actions are passing kicks, usually fairly short, in which a backspin is imparted to the soccer ball in order to cause it to stop its travel (by its spinning action against the ground). Improvements are needed in such annular-cleated shoes to facilitate such backspin kicks (or "chopkicks").

A number of more general considerations are applicable to soccer shoes as well, and are hereafter discussed at length:

While good pivotability is highly desirable, in certain cases it is desirable to control the degree of pivotability, but to do so without eliminating or substantially reducing the ability of the shoe to pivot while firmly planted. That is, without losing the pivotability characteristic which serves to avoid knee injuries and other leg injuries, having a measure of control in pivoting would be desirable.

Because of their structural characteristics, annular cleats can tend to reduce sole flexibility to come extent. But a high degree of sole flexibility is desirable because it gives the shoes a natural feeling, allowing the normal bending of the sole of the foot to be expressed through the sole of the shoe.

A high degree of sole flexibility is considered of particular importance in certain field sports, such as soccer, where complete control of foot movements is advantageous. The fine foot movements which are used in soccer for ball control are particular examples. Thus, having means to improve sole flexibility without sacrificing the advantages of pivotability would be desirable.

It is also believed that sole inflexibility can tend to be a negative factor with respect to sole wear characteristics, causing undue pressures at certain points in the sole. Having means to improve the degree of sole flexibility could be desirable in this respect, improving sole durability.

Another concern with cleated shoes is mud accumulations in the cleats. While this is not as significant a problem for the annular-cleated shoes of the aforementioned patents as it is for standard cleated shoes, it remains a concern, particularly for lightweight players. Increased sole flexibility can tend to further improve the mud-shedding qualities of such shoes. For this and other reasons, increased sole flexibility is especially important for lightweight athletes.

Good penetration of the ground is essential to obtaining excellent traction in cleated athletic shoes. There remains a need for still further improvement in shoe traction, and hence in shoe penetration, in order to achieve higher levels of athletic performance. Good penetration ability is particularly important to lightweight athletes, since penetration is aided by greater weight. This is particularly so if mud is present in the cleats in position to block or retard ground penetration.

Good ground penetration is also helpful for obtaining good pivotability in the annular-cleated shoes. Insufficient penetration will result in less ground bearing than is needed for the best possible improved pivotability.

Ground penetration will be affected by, among other things, the total cleat end area—that is, the total area of the distal surface(s) of the cleat or cleats. In general, the greater the total end area bearing on the ground, the more difficult it may be for an annular cleat to penetrate the ground; the smaller the total end area bearing on the ground, the easier is may be for an annular cleat to penetrate the ground. This affect is accentuated when the ground is hard.

Sharpening the distal end of the annular cleat reduces the total area of the distal surface and tends to enhance penetration, but may also cause some concern about possible injury from player contact with such sharp edges. With of these conflicting concerns, there is a need for an improved athletic shoe sole with cleating providing good ground penetration to insure the aforementioned excellent combination of traction and pivotability in a comfortable functional athletic shoe.

Good traction in various athletic movements on the playing field is of great importance. In particular, quick stopping ability is very important. Good ability to stop quickly from forward movement is helpful in many sports: good ability to stop quickly from rearward (backpedaling) movement is helpful as well, particularly for certain players such as those in defensive positions in soccer and football. There is a need for an improved athletic shoe sole providing enhanced stopping ability and enhanced traction on starting and accelerating.

It has been found that in some forms athletic shoes in accordance with the aforementioned U.S. Pat. No. 4,577,422 may make a snapping or clapping sound during running on wet ground—particularly when an athlete is running backwards. Opinions may differ on whether this is a negative, neutral or even a positive trait. On balance, however, eliminating or reducing such noise would be desirable.

Before describing the invention, a brief description of the foot and its pivoting and planted positions will be helpful. This can serve as an aid in understanding preferred embodiments of this invention.

The sole of the foot includes four basic portions. These are, in order back to front: the heel portion; the arch portion; the ball-of-the-foot portion; and the toe portion. The heel portion and the ball-of-the-foot portion are those portions which share most if not all of the player's weight when the player is in a normal standing position with his feet generally flat on the ground. In such position, the arch portion and toe portion bear little if any weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position the juncture of the phalanges (toe bones) and the metatarsals is the center of weight bearing. In other words, the center of weight bearing in the forward portions of the foot actually moves forward when a player shifts to the ready position.

The sole of an athletic shoe has portions immediately below such four foot portions which may be designated, and herein are designated, by the same terms.

OBJECTS OF THE INVENTION

It is an object of this invention to provide an improved pivoting athletic shoe, particularly for use in soccer and the like, overcoming certain problems indicated above.

Another object of this invention is to provide a soccer shoe which has improved pivotability and excellent traction and also facilitates backspin passing kicks made with the medial forefoot.

Another object of this invention is to provide an improved athletic shoe for soccer and the like which reduces the risk of common injuries, such as knee injuries.

Another object of this invention is to provide an athletic shoe with a substantially continuous annular cleat which penetrates the ground well to enhance its improved pivotability and good traction.

Another object of this invention is to provide a pivoting athletic shoe having good pivotability with a measure of pivoting control.

Yet another object of this invention is to provide an soccer shoe which controls pivoting while reducing the risk of injuries such as knee injuries.

Another object of this invention is to provide a pivoting soccer shoe which has good sole flexibility to improve its comfort and performance.

Another object of this invention is to provide a pivoting soccer shoe with improved durability.

Another object of this invention is to provide a pivoting soccer shoe having improved mud-shedding ability.

Still another object of this invention is to provide a pivoting soccer shoe allowing improved traction during certain athletic maneuvers.

Another object of this invention is to provide a pivoting soccer shoe allowing improved traction in starting and accelerating movements on the athletic playing field.

These and other objects will be apparent from the invention descriptions which follow.

BRIEF SUMMARY OF THE INVENTION

This invention is an improved sole for a shoe for soccor and the like providing excellent pivotability and traction, and overcoming certain problems and deficiencies noted above. The sole of this invention provides such pivotability without impeding the ability to make backspin passing kicks with the medial forefoot, as are common in soccer. The shoe also provides improved ground penetration; improved sole flexibility; improved mud-shedding ability; improved stopping, starting and accelerating characteristics; and good sole durability.

The athletic shoe sole of this invention includes a main sole surface and an annular cleat projecting therefrom and terminating in a distal edge. The annular cleat is recessed from the medial edge of the sole, as hereafter described, to facilitate the aforementioned backspin passing kicks. In preferred embodiments, the distal edge has breaks in it along its opposite sides to provide other advantages, including those enumerated above.

The annular cleat extends along a substantially circular path which encompasses a major area of the ball-of-the-foot and toe portions and is centered substantially on the juncture of such sole portions. Such path includes or encloses most of the ball-of-the-foot and toe portions, and is forward of the arch portion, as defined above. The substantially circular path along which the annular cleat extends has opposed medial and lateral main side portions which are centered substantially on the juncture of the ball-of-the-foot and toe portions of the sole.

The medial main side portion of the annular cleat is spaced from the sole medial edge by a distance substantially greater than the lateral main side portion is from the sole lateral edge. The lateral main side portion is closely aligned with the sole lateral edge, while the medial main side portion, more specifically, the distal edge thereof, is recessed from the sole medial edge by a distance not exceeding about twice the height of the annular cleat near such medial main side portion, and most preferably not exceeding about the height of the cleat at that location. Such recessed distance is preferably more than about one-half the height of the annular cleat near such medial main side portion.

Such recessing does not detract significantly from the broad ground bearing provided by the annular cleat. But, given the orientation of a player's foot in making backspin passing kicks of the type described, such recessing serves to remove concern about ground impedance or interference, allowing such kicks to be made with normal confidence and without adjustment.

The extent of such recessing depends on various factors, including cleat height and the typical foot angle in backspin passing kicks. Short cleats need not be recessed as far as long cleats to obtain the same benefits, but recessing is greater in proportion to cleat height for short cleats. If the angle of the foot (to horizontal) is usually fairly small, it is best to have substantial recessing; if foot angle is usually somewhat greater, the preferred extent of recessing may be somewhat reduced.

In some cases, the aforementioned breaks along the main side portions in preferred embodiments each have a forward wall tapered to widen the break toward the distal edge of the annular cleat and a rearward wall substantially normal (that is, perpendicular) to the main sole surface. In such configuration, traction when stopping from forward movement is enhanced. In other preferred embodiments with side breaks, the breaks have their rearward walls tapered to widen the break toward the distal edge of the annular cleat and their forward walls substantially normal to the main sole surface. This tends to improve traction when stopping from movement in a rearward direction, and improves traction when starting and accelerating in a forward direction.

In one preferred embodiment, the opposed breaks in the opposed main side portions include a single break along each main side portion, such break extending to the main sole surface along its complete length and width. This forms a flexing region of some width across the sole, extending on either side of the juncture of the ball-of-the-foot and toe portions.

In such configurations, it is preferred that the forward and rearward walls of each single break be substantially normal to the main sole surface. This provides good stopping and starting traction in both the forward and rearward directions.

In other preferred embodiments, the opposed breaks are pairs of breaks along each main side portion, each pair forming therebetween one of two opposed annular cleat middle sections on the juncture of the ball-of-the-foot and toe portions. This accommodates a central cleat which may be located midway between the opposed annual cleat side portions on a line between the midpoints thereof. This allows the advantage of a central cleat, to serve as a focal point for pivoting, without interfering with the sole flexibility provided by virtue of the opposed breaks.

In embodiments with two breaks along each main side portion, it is preferred that forward and rearward break walls be tapered in a particular manner. In one embodiment, the breaks have forward walls tapered to widen the breaks toward the distal edge and rearward walls substantially normal to the main sole surface, such that traction when stopping from forward movement is enhanced. When stopping from rearward movement is particularly important, the reverse configuration, with breaks having rearward walls tapered to widen the breaks toward the distal edge and forward walls substantially normal to the main sole surface, is preferred. The latter configuration is helpful to defensive players who backpedal, suddenly stop, and quickly start forward.

The walls of the breaks which are normal to the main sole surface have a greater tendency to temper pivotability than the tapered walls. It is noted that pivotability in clockwise or counter-clockwise directions can be facilitated or tempered by orienting the walls of the breaks accordingly, including having opposite tapering on opposite sides of the annular cleat, as desired.

The opposed breaks in each of the forms described above greatly improve sole flexibility, as already noted. Sole flexibility can be further enhanced by placing very shallow grooves across the sole between pairs of opposed breaks. When there are two breaks along each of the opposed main side portions, a pair of grooves can be used to extend across the sole on a line between the deepest portions of opposite breaks.

The opposed breaks provide another important advantage: They reduce the total surface area of the annular cleat distal edge which must penetrate into the ground. This in turn improves ground penetration, with a resulting improvement in traction and improved ground bearing for better pivotability.

It has been found that the benefits of improved pivotability and excellent traction provided by the athletic shoe described in U.S. Pat. No. 4,577,422 are further enhanced and made more practically useful for soccer and the like by the improvements described and claimed herein.

As earlier noted, the distal edge of the annular cleat, a major portion of which is preferably in a plane spaced from the main sole surface, is preferably a flat surface. This bluntness improves the safety of the shoe. And, in the configuration of this invention such bluntness does not significantly detract from the ground penetration which is needed for good traction and pivotability.

A rear passageway may be formed by the annular cleat between the main sole surface and plane defined by the major portion of the distal edge of the annular cleat. Such rear passageway extends across a portion of the width of the sole, between first and second positions which are on the ball-of-the-foot portion of the sole and near the arch portion. each being spaced rearwardly from one of the opposed main side portions.

In a particularly preferred form of the rear passageway, the annular cleat is shortened between the aforementioned first and second positions, and the distal edge forms a concave length between such positions. Such concave length has a center portion converging toward the main sole surface so that the annular cleat is progressively shorter in length at positions progressively closer to the midpoint between the first and second positions.

A rear passageway can take other forms instead. For example, rather than a shortening of the annular cleat there can be an elimination of such cleat between the aforesaid two positions. Surprisingly, such void, in the position just forward of the arch portion of the sole, does not detract from the pivoting performance of the shoe, even though such void is on the ball-of-the-foot portion of the sole.

Such rear passageway, along with the aforementioned opposed breaks, provides important advantages. Eliminating or drastically shortening the rear portion of the annular cleat allows a still greater amount of the weight of the athlete to be applied to the ground through the remaining portions of the cleat. This further improves the degree of ground penetration and helps to insure good traction and provide a good base for pivoting. Having such a rear passageway also improves sole flexibility in the sole area across the rear of the cleat.

The annular cleat, rather than being a number of widely separated individual cleats, remains a single cleat and is appropriately described as "substantially continuous," despite the various cleat characteristics described herein.

The aforementioned breaks and passageway also allow air to pass out of the space enclosed by the annular cleat, the main sole surface, and the ground as the sole bites into the ground. This tends to reduce or even eliminate the aforementioned clapping sound. Such sound was caused, it is believed, by air compressed within such space being suddenly released through a small space such as any irregularity in the ground.

The annular cleat preferably has radially-inward and outward annular side surfaces which converge to the distal edge. The outward side surface preferably is normal to main sole surface. This helps to provide as wide a base as possible to support the foot of the athlete. The inward side surface preferably flares radially outwardly to the distal edge and is curved in cross-section to merge gently with the main sole surface. This tends to further minimize the accumulation of mud.

The annular cleat preferably is centered beneath the juncture of the phalanges and metatarsals, that is, at the juncture of the ball-of-the-foot and toe portions of the sole. All non-cleat areas of the sole area enclosed by such annular cleat are preferably coincident with the main sole surface, that is, not substantially built up. This allows full turf penetration by the annular cleat. In preferred embodiments, the circular cleat is the forwardmost cleat on the shoe.

DETAILED DESCRIPTION OF PREFERRED EMBODIMENTS

The figures illustrate three athletic shoe soles 12, 13 and 14 in accordance with this invention. Soles 12, 13, and 14 are affixed to shoe uppers in the normal way. The uppers are of conventional materials like leather, canvas, nylon mesh and other synthetics, but their construction is not part of the invention. The soles are of a material like polyurethane, nylon, rubber or blends (like nylon-polyurethane), which is wear-resistant but can flex in the normal manner depending on how weight is applied.

The lower surfaces of soles 12, 13 and 14, which contact the surface of the playing field, each include a main sole surface 16 which is a generally flat even surface from which cleats project. The cleats are preferably integrally formed with main sole surface 16 in a molding process of well-known type.

Figure 1:
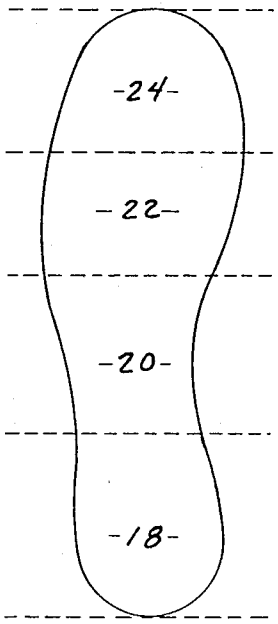
FIG. 1 is a cleatless schematic plan view of an athletic shoe sole, illustrating the portions thereof.

As illustrated in schematic FIG. 1, the sole has four portions which are defined by the portions of the foot adjacent to them. These are: a heel portion 18, immediately below the player's heel; an arch portion 20, below the arch of the player's foot; a ball-of-the-foot portion 22, below the ball of the player's foot; and a toe portion 24, below the player's toes.

As previously noted, the ball of the foot and the heel bear weight when the player is standing in a flat-footed stance, while the toe and ball-of-the-foot portions bear weight when the player is in the ready position.

Annular cleats 25, 26 and 27 project from main sole surfaces 16 of soles 12, 13 and 14, respectively. Annular cleats 25, 26 and 27 are each centered on the juncture of the ball-of-the-foot and toe portions 22 and 24, and extend along a substantially circular path all of which is forward of arch portion 20. Such circular paths of the annular cleats each encompass a major area which includes most of ball-of-the-foot and toe portions 22 and 24.

Annular cleats 25, 26 and 27 each enclose a sole area 30 all of which, except for a center cleat 28 on soles 12 and 13, hereafter described, is coincident with main sole surface 16. That is, there are no substantial built-up portions in enclosed sole area 30 which can retard penetration of the playing surface by annular cleats 25, 26 and 27, and, in the case of soles 12 and 13, by center cleat 28 as well. Sole area 30, however, may have texturing or other surface characteristics of minor vertical dimension.

As mentioned above and as illustrated in FIGS. 2, 5 and 6, a single standard frustoconical center cleat 28 is located at or very close to the center point of the sole area defined by each of the annular cleats 25 and 26 or soles 12 and 13. Cleat 28 serves as an additional traction means at the focal point of pivoting.

Annular cleats 25, 26 and 27 each terminate in a distal edge 32 which is preferably a flat surface, as shown. Such bluntness of distal edge 32 improves the safety of the shoes. Distal edge surface 32 includes a major portion 34 substantially in a single plane (except, of course, when the sole is flexed). The plane defined by the major portion 34 of distal edge 32 is useful in describing certain preferred features of the soles of this invention.

Each of the substantially circular paths followed by annular cleats 25, 26 and 27 of soles 12, 13 and 14 has two opposed main side portions 60 and 62 which are centered substantially on the juncture of the ball-of-the-foot and toe portions 22 and 24 of the sole. Along main side portions 60 and 62 the annular cleats are at substantially their closest positions with respect to the medial and lateral sole edges 64 and 66, respectively. Main lateral portions 60 and 62 are called medial and lateral main side portions, respectively.

Lateral main side portion 62 in each embodiment is closely aligned with lateral sole edge 66. But medial main side portion 60 is spaced from medial sole edge 64, preferably by a distance not exceeding about twice, and most preferably about once, the height of the cleat at medial main side portion 60. Spacing greater than the upper limit would provide no further significant advantage in facilitating backspin passing kicks with the medial forefoot, but would detract from favorable ground-bearing characteristics of the shoe and hence from the improved pivotability and excellent traction provided by such annular-cleated shoes.

The spacing between medial main side portion 60 and sole medial edge 64 is preferably greater than about one-half the height of the annular cleat at medial main side portion 60. At spacing less than that, some undesirable interference of the annular cleat with the ground during the aforementioned backspin passing kicks would be experienced.

In the embodiments shown, the spacing of medial main side portion 60 from sole medial edge 64, for an adult shoe of about average size, is about 9 mm., while the height of the annular cleat at medial main side portion 60 is about 13 mm.

Referring now specifically to sole 12, shown in FIGURES 2–6, annular cleat 25 has first and second opposed breaks 68 and 70 along each of opposed main side portions 60 and 62. Breaks 68 and 70 extend from distal edge 32 to main sole surface 16. Each pair of breaks 68 and 70 define therebetween one of two opposed annular cleat middle sections 72 and 74 on the juncture of ball-of-the-foot and toe portions 22 and 24 of sole 12.

Center cleat 28, previously described, and opposed annular cleat middle sections 72 and 74 are arranged such that center cleat 28 is located between middle portions 72 and 74, substantially on a line between the midpoints of such side portions. This arrangement facilitates flexing and bending of sole 12 along the line between the two first opposed breaks 68 and along the line between the two second opposed breaks 70. Thus, superb flexing and bending are possible near the juncture of ball-of-the-foot and toe portions 22 and 24 without sacrificing center cleat 28 and the traction and pivoting advantages which it provides.

Along each of these two flex lines is a shallow groove 76 in main sole surface 16, running parallel to the juncture of ball-of-the-foot and toe portions 22 and 24. Grooves 76, which are on the order of 1 mm. in depth, further facilitate flexing of sole 12. While grooves 76 are preferred features, main sole surface 16 can instead be flat or in some cases, slightly raised lines can extend across sole 12 at the same locations.

Referring primarily now to FIGS. 3–6, each of the four breaks 68 and 70 has a forward wall 78 which is tapered such that the break is wider toward distal edge 32 of annular cleat 25. Each of the four breaks 68 and 70 also has a rearward wall 80 which is substantially normal to main sole surface 16. The front tip of the shoe sole in FIGS. 3–5, and in the other figures as well, is identified by numeral 77 for ease in understanding the break configurations. The break configurations shown in FIGURES 3–5 enhances traction when stopping quickly from forward movement. It also provides a measure of control in pivoting.

Figures 2, 3, 4, 5, 6, 7, 8:
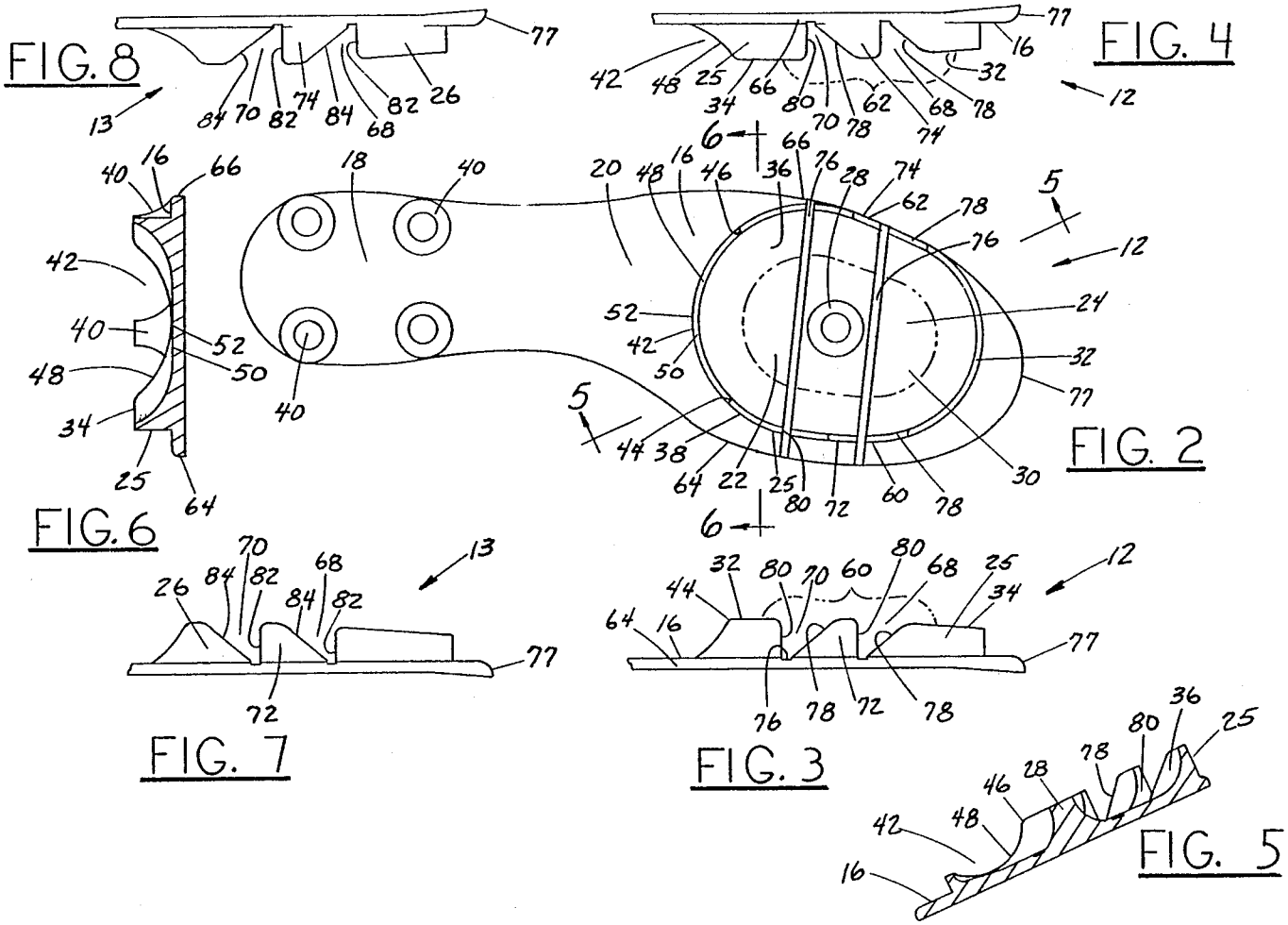
FIG. 2 is a plan view of a preferred athletic shoe sole in accordance with this invention.
FIG. 3 is a fragmentary bottom view of FIG. 2.
FIG. 4 is a fragmentary top view of FIG. 2.
FIG. 5 is a sectional view, taken along section 5—5 as indicated in FIG. 2.
FIG. 6 is a fragmentary sectional view; taken along section 6—6 as indicated in FIG. 2.
FIGS. 7 and 8 are views comparable to FIGS. 3 and 4, respectively, illustrating an alternate embodiment of this invention.

FIGS. 7 and 8 illustrate a variation of the break configuration just described. The tapering of the break walls is reversed in annular cleat 26 of sole 13. Each of the breaks in sole 13 has a forward wall 82 which is normal to main sole surface 16 and a rearward wall 84 which is tapered such that the break is wider toward distal edge 32. This break configuration enhances traction when stopping quickly from rearward movement and when starting and/or accelerating in forward movement.

Another feature of soles 12 and 13 is the rear passageway 42 along a portion of the annular cleat 26. Rear passageway 42 is between the aforementioned plane, defined by major portion 34 of distal edge 32 of each of the annular cleats 25 and 26, and main sole surface 16. In the preferred form shown in the drawings, rear passageway 42 extends across a portion of the width of the sole between first and second positions 44 and 46, which are on ball-of-the-foot portion 22 near arch portion 20. each spaced rearwardly from one of the opposed main side portions 60 and 62. Positions 44 and 46 are both along the circular paths along which annular cleats 25 and 26 extend.

Between first and second positions 44 and 46, distal edge 32 is positioned at a level between main sole surface 16 and the plane defined by major portion 34 of distal edge 32. As best illustrated in FIG. 6, the portion of distal edge 32 between first and second positions 44 and 46 forms a concave length 48. Concave length 48 has a center portion 50 which converges toward main sole surface 16, such that annular cleat 26 is progressively shorter in length at positions progressively closer to the mid-point 52 between first and second positions 44 and 46.

A rear passageway can be in a variety of forms. Instead of the preferred form shown in the drawings, in which the annular cleat is, in effect, drastically shortened, distal edge 32 can merge with main sole surface 16 such that a more complete void is along a minor portion of the circle along which the annular cleat runs, at or near the position just forward of arch portion 20. Such void, in the position just forward of arch portion 20, does not detract from the pivoting performance of the shoe.

Rear passageway 42 and breaks 68 and 70 provide certain other advantages. Their presence means that the athlete's weight is more concentrated on the ground through major portion 34 of distal edge 32. This helps to insure that the annular cleat will penetrate the ground sufficiently to provide good traction, and to provide a good base for pivoting.

Furthermore, breaks 68 and 70 and rear passageway 42 allow passage of air out of the space enclosed by the annular cleat, main sole surface 16, and the ground as the player's foot bites into the ground. This reduces or eliminates the clapping sound which can occur if air is compressed within such space and then suddenly is released through a small passageway, such as an irregularity in the ground.

Figure 11:
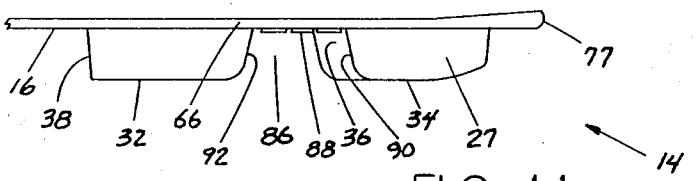
FIGS. 10 and 11 are fragmentary bottom and top views, respectively, of FIG. 9.
Figure 9:
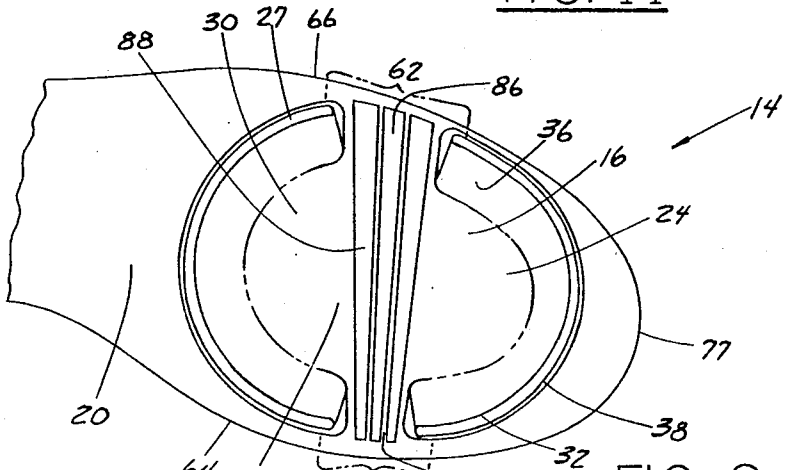
FIG. 9 is a fragmentary plan view of still another embodiment of this invention.
Figure 10:
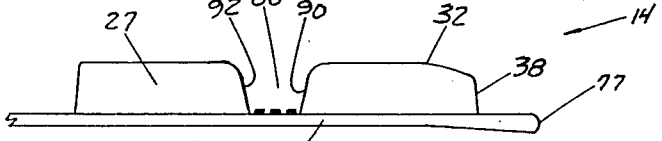

Turning now specifically to athletic shoe sole 14, illustated in FIGS. 9–11, annular cleat 27 has a single break 86 along its distal edge in each of the opposite sides. More specifically, a single break 86 is in annular cleat 27 along its medial main side portion 60, and a single break is in annular cleat 27 along its lateral main side portion 62.

Each of the breaks 86 extends to main sole surface 16 along substantially the complete length and width of the break. Such wide, substantially non-tapered break configuration forms a flexing region 88 extending across sole 14 on either side of the junction of ball-of-the-foot and toe portions 22 and 24. Flexing region 88 provides excellent sole bendability, yet does not detract substantially from the pivoting qualities of the sole.

Each single break 86 has a forward wall 90 and rearward wall 92 which are substantially normal to main sole surface 16. This break configuration enhances stopping and starting traction in both the forward and rearward directions, and is particularly useful for athletes whose positions require quick forward/backward changes of direction for whatever reason.

Sole 14 provides excellent penetration of the ground and therefore provides excellent traction. And, as noted, the pivoting qualities of sole 14 are exellent.

Annular cleats 25, 26 and 27 each have radially-inward and outward annular lateral surfaces 36 and 38 which converge to distal edge 32. Outward lateral surface 38 is normal to main sole surface 16, thus providing as wide a base as possible to support the foot of the athlete. Inward lateral surface 36 flares radially outwardly to distal edge 32, and is curved in cross-section to merge gently with main sole surface 16, thus minimizing nooks and crannies in which mud might accumulate. Such gentle merging can be described by referring to main sole surface 16 as joining inward lateral surface 36 tangentially.

The outward lateral surface of the annular cleat along medial main side portion 60 may be tapered (beveled) from the distal edge of the cleat at that location to sole medial edge 64 at main sole surface 16. Thus, distal edge 32 would be recessed, as required herein, but the cleat would include reinforcing material along its outside annular surface at positions closer to main sole surface 16. Such reinforcement would not interfere with the ground during backspin passing kicks; indeed, such reinforcement (beveling) would slide easily along the ground during such kicks. Such lateral beveling may be carried around to other portions of the cleat as well, particularly at the forward portions thereof.

A number of generally frustoconical cleats 40 are formed on heel portion 18 of soles 12, 13 and 14. A variety of heel cleats may be used on the shoe of this invention. The heel cleat characteristics do not form part of this invention.

While the principles of this invention have been described in connection with specific embodiments, it should be understood clearly that these descriptions are made only by way of example and are not intended to limit the scope of the invention.

What is claimed is:

1. In an athletic shoe sole of the type having a main sole surface and cleats extending therefrom, and having heel, arch, ball-of-the-foot and tow portions and medial and opposed lateral sole edges extending therealong, the improvement comprising a substantially circular annular cleat which has a forward portion positioned sufficiently forward such that the annular cleat encompasses most of each of the ball-of-the-foot and toe portions, said annular cleat having medial and lateral ground-contacting main side portions which are centered substantially on the juncture of the ball-of-the-foot and tow portions, the medial main side portion being spaced from the medial sole edge by a distance substantially greater than the lateral main side portion is from the sole lateral edge, thereby facilitating medial edge kicking in a shoe with improved pivotability and traction.

2. The athletic shoe sole of claim 1 wherein the medial main side portion is spaced from the medial edge by a distance not exceeding about the height of the annular cleat near the medial main side portion.

3. In an athletic shoe sole of the type having a main sole surface and cleats extending therefrom, and having heel, arch, ball-of-the-foot and toe portions and medial and opposed lateral sole edges extending therealong, the improvement comprising a substantially circular annular cleat having a distal edge and having a forward portion positioned sufficiently forward such that said annular cleat encompasses most of each of the ball-of-the-foot and toe portions, said annular cleat having medial and lateral ground-contact main side portions which are centered substantially on the juncture of the ball-of-the-foot and toe portions, the lateral main side portion being closely aligned with the sole lateral edge and the distal edge, and the medial main side portion being recessed from the medial sole edge by a distance not exceeding about twice the height of the annular cleat near the medial main side portion, thereby facilitating medial edge kicking in a shoe with improved pivotability and traction.

4. The athletic shoe sole of claim 3 wherein the distal edge at the medial main side portion is recessed from the medial sole edge by a distance not exceeding about the height of the annular cleat near the medial main side portion.

5. The athletic shoe sole of claim 3 further including opposed breaks along the distal edge of the annular cleat in the main side portions, whereby sole flexibility is improved.

6. The athletic shoe sole of claim 5 wherein the opposed breaks comprise a single break along each main side portion extending substantially to the main sole surface along substantially the complete length and width of each such break to form a flexing region across the sole extending on either side of said juncture.

7. The athletic shoe sole of claim 6 wherein the single break has forward and rearward walls substantially normal to the main sole surface.

8. The athletic shoe sole of claim 5 wherein the opposed breaks comprise a pair of breaks along each main side portion, each pair defining therebetween one of two opposed annular cleat side portions on said juncture.

9. The athletic shoe sole of claim 8 further including a central cleat midway between the opposed annular cleat side portions on a line between the midpoints thereof.

10. In an athletic shoe sole of the type having a main sole surface and cleats extending therefrom, and having heel, arch, ball-of-the-foot and toe portions and medial and opposed lateral sole edges extending therealong, the improvement comprising:

an annular cleat having a distal edge, said annular cleat extending along a substantially circular path which encompasses a major area of the ball-of-the-foot and toe portions and is, and has medial and lateral main side portions which are centered substantially on the juncture of the ball-of-the-foot and toe portions;

the lateral main side portion being closely aligned with the sole lateral edge and the distal edge, and the medial main side portion being recessed from the medial sole edge by a distance not exceeding about twice the height of the annular cleat near the medial main side portion;

said annular cleat having a pair of breaks along the distal edge in each of the main side portions, said breaks having forward walls tapered to widen the breaks toward the distal edge and rearward walls substantialy normal to the main sole surface;

each such pair of breaks having a cleat middle section therebetween on the juncture of the ball-of-the-foot and toe portions; and a central cleat midway between the two cleat middle sections on a line between the midpoints thereof, whereby excellent sole flexibility and enhanced traction when stopping from forward movement are provided in a shoe having improved pivotability and medial edge kicking ability.

11. In an athletic shoe sole of the type having a main sole surface and cleats extending therefrom, and having heel, arch, ball-of-the-foot and toe portions and medial and opposed lateral sole edges extending therealong, the improvement comprising:

an annular cleat having a distal edge, said annular cleat extending along a substantially circular path which encompasses a major area of the ball-of-the-foot and toe portions and is, and has medial and lateral main side portions which are centered substantially on the juncture of the ball-of-the-foot and toe portions;

the lateral main side portion being closely aligned with the sole lateral edge and the distal edge, and the medial main side portion being recessed from the medial sole edge by a distance not exceeding about twice the height of the annular cleat near the medial main side portion;

said annular cleat having a pair of breaks along the distal edge in each of the main side portions, said breaks having rearward walls tapered to widen the breaks toward the distal edge and forward walls substantially normal to the main sole surface;

each such pair of breaks having a cleat middle section therebetween on the juncture of the ball-of-the-foot and toe portions; and a central cleat midway between the two cleat middle sections on a line between the midpoints thereof, whereby excellent sole flexibility and enhanced traction when stopping from rearward movement are provided in a shoe having improved pivotability and medial edge kicking ability.

* * * * *